US006240678B1

(12) United States Patent
Spether

(10) Patent No.: US 6,240,678 B1
(45) Date of Patent: Jun. 5, 2001

(54) CAPPING HEAD WITH TORQUE ADJUSTMENT

(76) Inventor: Karl Heinz Spether, Stahlbuehiring 2, D-68523 Ladenburg (DE)

( * ) Notice: Subject to any disclaimer, the term of this patent is extended or adjusted under 35 U.S.C. 154(b) by 0 days.

(21) Appl. No.: 09/333,451

(22) Filed: Jun. 15, 1999

Related U.S. Application Data

(60) Provisional application No. 60/092,132, filed on Jul. 9, 1998.

(51) Int. Cl.[7] ..... B65B 3/20

(52) U.S. Cl. ..... 50/317; 53/331.5; 53/318

(58) Field of Search ..... 53/490, 487, 331.5, 53/317, 318, 334; 192/56.4, 56.41, 84.5

(56) References Cited

U.S. PATENT DOCUMENTS

| | | | |
|---|---|---|---|
| 4,304,611 | 12/1981 | Ellis | 134/23 |
| 4,364,218 | 12/1982 | Obrist | 53/331.5 |
| 4,492,068 | 1/1985 | Obrist | 53/331.5 |
| 4,599,846 | 7/1986 | Ellis et al. | 53/331.5 |
| 4,604,853 | 8/1986 | Albrecht et al. | 53/487 |
| 4,633,646 | 1/1987 | Ellis et al. | 53/331.5 |
| 4,674,264 | 6/1987 | Ellis et al. | 53/331.5 |
| 5,197,258 | 3/1993 | Johanek | 53/317 |
| 5,284,001 * | 2/1994 | Ochs | 53/317 |
| 5,313,765 | 5/1994 | Martin | 53/317 |
| 5,490,369 | 2/1996 | Ellis et al. | 53/317 |

FOREIGN PATENT DOCUMENTS 8602917 11/1984 (WO) .

* cited by examiner

*Primary Examiner*—John Sipos
(74) *Attorney, Agent, or Firm*—Thomas R. Trempus

(57) ABSTRACT

A capping head assembly has a first housing with a spindle mounting collar and supports a clutch housing. The clutch housing has an upper portion with a first magnetic ring and a lower portion with a second magnetic ring. The lower portion is freely rotatable relative to the upper portion and permits the adjustment of the air gap between the first and second magnetic rings. A locking mechanism maintains the adjusted air gap at a selected value that represents a definable torque level in the magnetic clutch. The capping head also includes a post assembly calibration system that establishes a known reference point, which compensates for manufacturing tolerances between individual capping heads.

31 Claims, 6 Drawing Sheets

CAPPING HEAD WITH TORQUE ADJUSTMENT

RELATED APPLICATIONS

This application claims the benefit of U.S. Provisional Application No. 60/092,132, filed Jul. 9, 1998.

FIELD OF THE INVENTION

This invention relates to a screw capping head with a magnetic clutch for applying pre-threaded closures onto threaded containers. More particularly, the invention provides a capping head with torque adjustment features.

BACKGROUND OF THE INVENTION

Capping machines for the application of prethreaded closures onto prethreaded containers have been known for some time. In order to ensure that a prethreaded closure is not applied too tightly, which could possibly result in damage, conventional screw capping machines are provided with a screw capping head often called a "headset" having a torque dependent clutch. The clutch limits the maximum torque which can be transmitted to the prethreaded closure. Clutches of various types have been used. These have included slipping clutches and mechanical torque limiting clutches and also magnetic clutches. One example of a magnetic clutch is shown in U.S. Pat. No. 5,490,369 to Ellis et al., which is assigned to the Aluminum Company of America and which in incorporated herein by reference. Other examples of clutches are disclosed in U.S. Pat. Nos. 4,364,218; 4,492,068; 4,674,264; and 5,197,258. While many prior types of clutches have been generally satisfactory, many have not adapted themselves to ready adjustability, thus resulting in substantial down time when changes in the amount of applied torque are required due to different closures being applied, application forces required, etc. The Ellis et al., U.S. Pat. No. 5,490,369 teaches a capping head with an adjustable magnetic clutch consisting of opposed rings of magnet. One of the rings is disposed in a piston ring assembly that is adjustable relative to the other magnetic ring in order to vary the torque limit of the clutch.

SUMMARY OF THE INVENTION

Briefly, the screw capping head of this invention relates to a head assembly for applying prethreaded closures onto prethreaded containers which provides for readily changing the torque to be applied to the various closures, thus making the capping head adaptable to be used with a variety of different closures and containers.

A capping head incorporating the instant invention includes a first housing assembly adapted to be secured to a rotatable drive spindle. A clutch housing is mounted onto the first housing assembly and adapted for axial movement relative to the housing. The clutch assembly has an upper portion and a lower portion. The upper portion includes a magnetic clutch comprising a first circular ring of magnets secured to the portion of the clutch to which the drive spindle is connected. A clutch lower housing portion is in axial alignment with and mounted for free rotation relative to the clutch housing upper portion. The clutch housing lower portion comprises a second ring of magnets axially spaced from the first ring of magnets, which are mounted in the clutch housing upper portion. Together, the first and second rings of magnets define a magnetic clutch. The gap between these axially spaced sets of magnets determines the torque to be applied to the closure. The clutch is capable of slipping after the application of a prethreaded closure onto a prethreaded container when the desired torque value has been reached or exceeded. Essentially, the mode of operation is that as the chuck engages the cap upon the container to be capped, a top load is provided for cap-to-container sealing and/or for adequate rotary frictional engagement between the chuck and the cap by slight telescoping of the spindle and housing to compress a spring disposed therebetween. The magnetic attraction between the magnetic rings will impart at torque load from the housing which rotates with the drive spindle with the chuck assembly. This torque load permits the chuck assembly to engage and tighten the cap which has previously been threadedly engaged onto a container to a predeterminable tightness beyond which the mechanical resistance to further tightening overcomes the magnetic attraction. When this occurs, the magnetic clutch assembly merely slips as the spindle and associated housing continue to rotate with respect to the clutch lower housing portion.

The magnetic clutch assembly of the instant invention provides a mechanism for the calibration of the magnetic torque load to any number of predetermined set positions. Additionally, once a predetermined set position is established such as after the manufacture of the clutch assembly, the actual torque of the magnetic clutch can be adjusted through a range of values from, for example, a magnetic torque of 7.0 inch pounds to 22.5 inch pounds, by means of a predetermined set of incremental adjustments. These adjustments are possible through the use of an adjusting ring that permits the selected change of the torque value from a first predetermined value to a second (or different) predetermined value. Furthermore, the nature of the adjusting ring permits the return from the second predetermined value to the first predetermined value through a simple incremental movement of the adjustment ring.

Therefore, in summary, a capping head assembly comprises a first housing having a spindle mounting collar means and means for supporting a clutch housing. The clutch housing has an upper portion with a first magnetic ring means and a lower portion with a second magnetic ring. The lower portion is freely rotatable relative to the upper portion of the clutch housing. The lower portion includes means for establishing an adjustable air gap between the first and second magnetic rings. Locking means maintain the means for adjusting an air gap at a selected position.

It is therefore an object of this invention to provide an improved capping head with a magnetic clutch that permits the selection of a torque load.

It is a further object of this invention to provide a capping head with a magnetic clutch that can be calibrated during assembly to compensate for manufacturing tolerances that might cause the magnetically driven torque forces to vary from unit to unit.

It is yet another object of this invention to provide a capping head with a structure that facilitates the wash down or cleaning of the capper head and associated support equipment.

BRIEF DESCRIPTION OF THE DRAWINGS

The above as well as other features and advantages of this invention can be more fully appreciated through consideration of the detailed description of the preferred embodiment in conjunction with the accompanying drawings in which.

DETAILED DESCRIPTION OF THE PREFERRED EMBODIMENT

Figure 1:
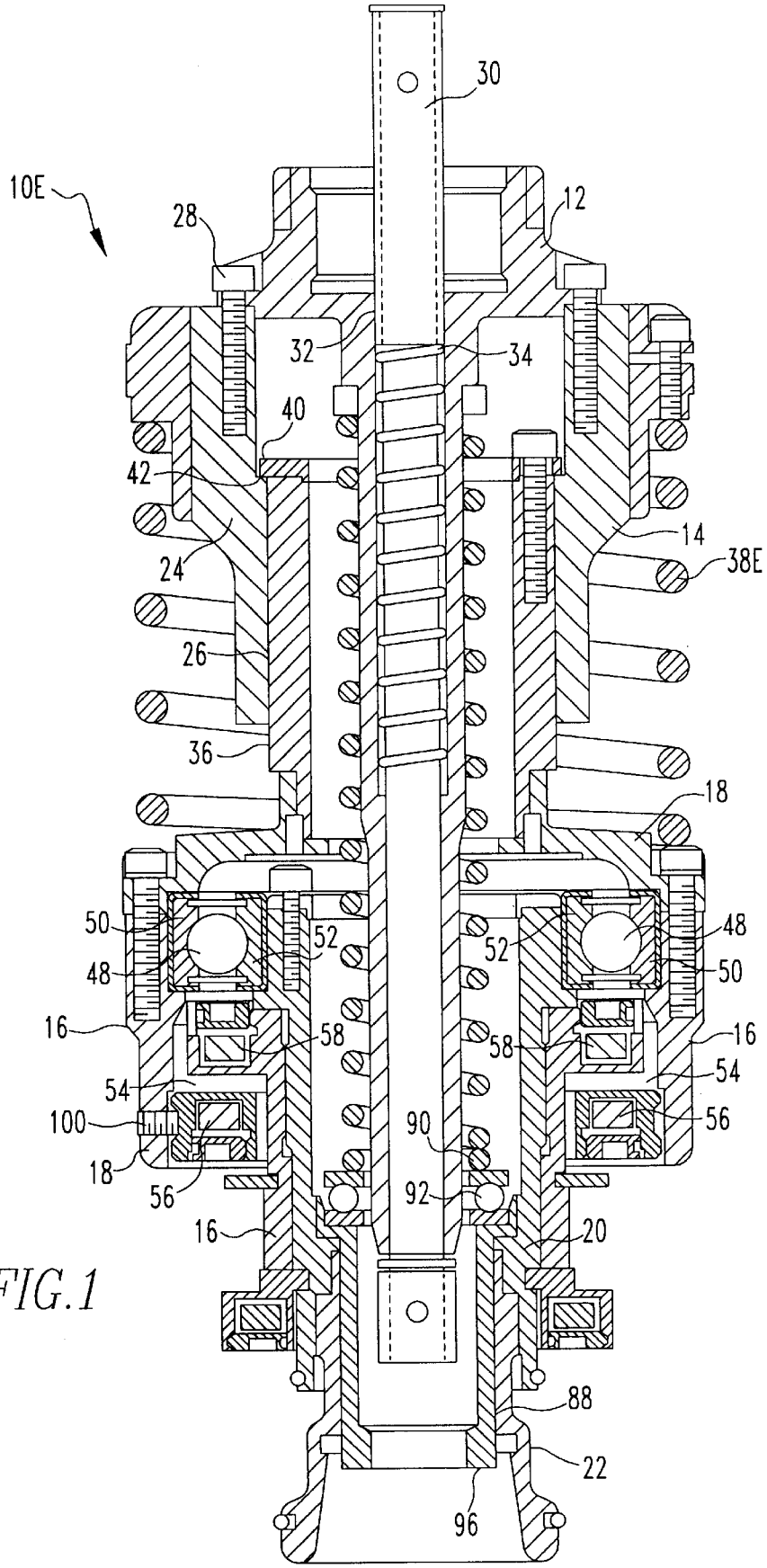
FIG. 1 is a cross sectional view of a capping head embodying the present invention.
Figure 2:
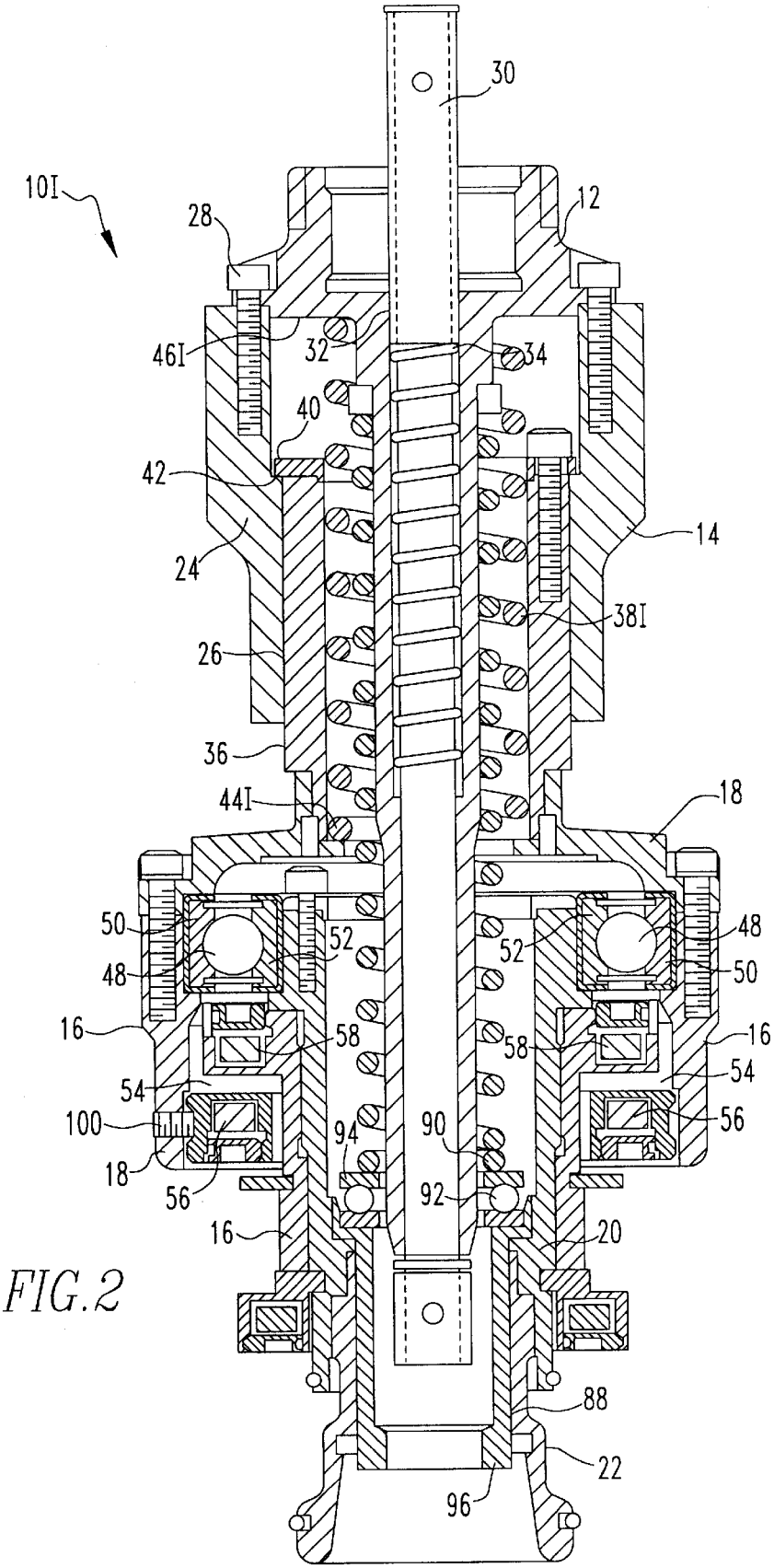
FIG. 2 is a cross sectional view of an alternative embodiment of the capping head of this invention.
Figure 3A:
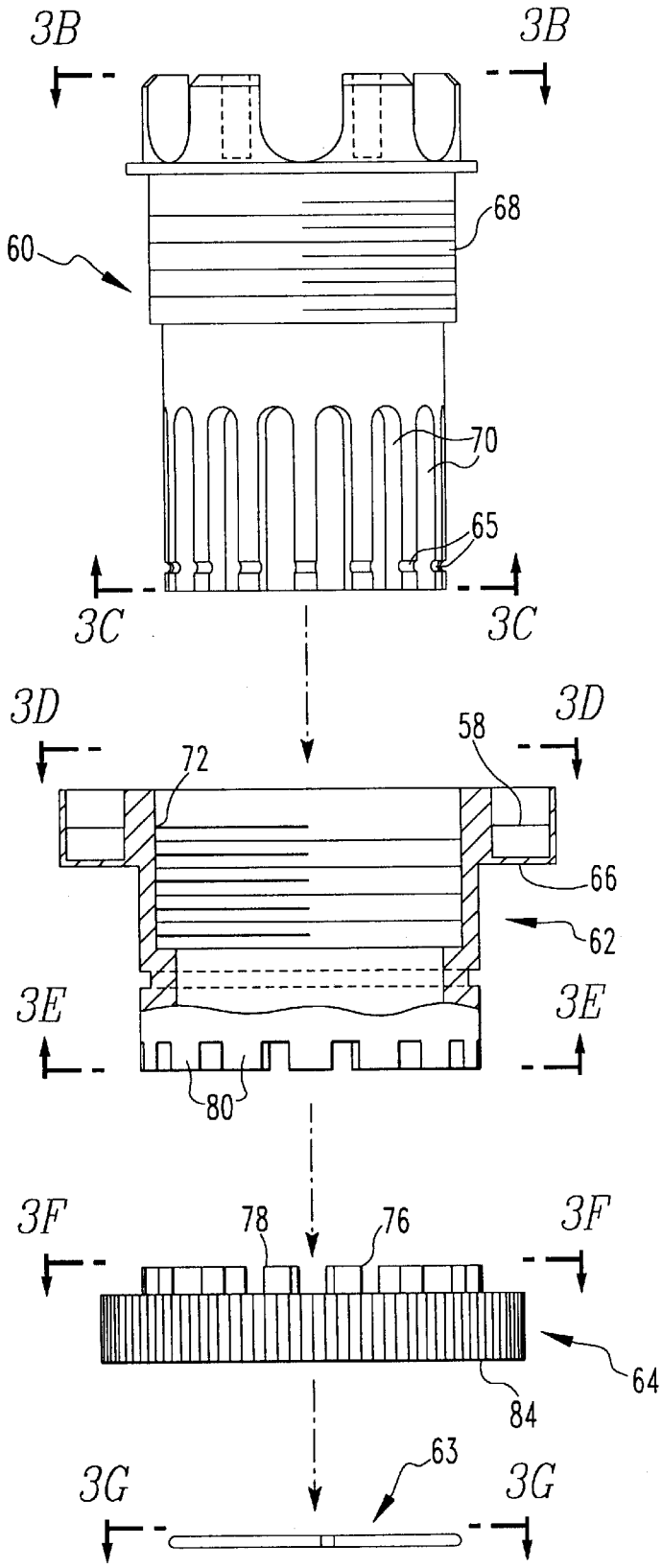
FIGS. 3A through 3G is a view generally taken along lines 3—3 of FIG. 1 illustrating in an exploded view, the clutch housing lower portion and sections therethrough.
Figure 3B:
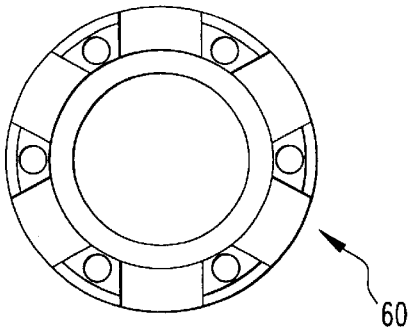
Figure 3D:
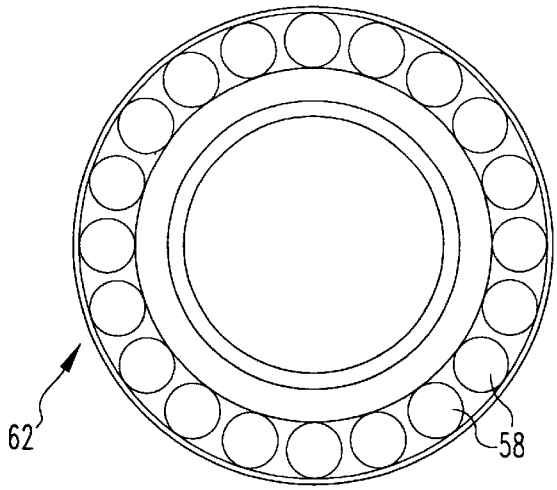
Figure 3C:
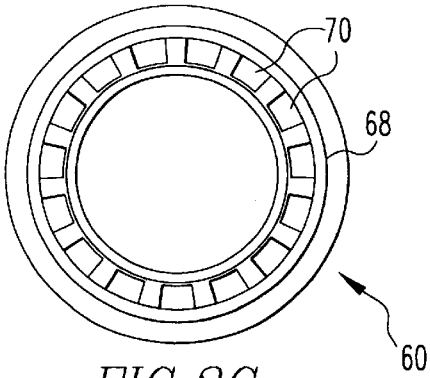
Figure 3E:
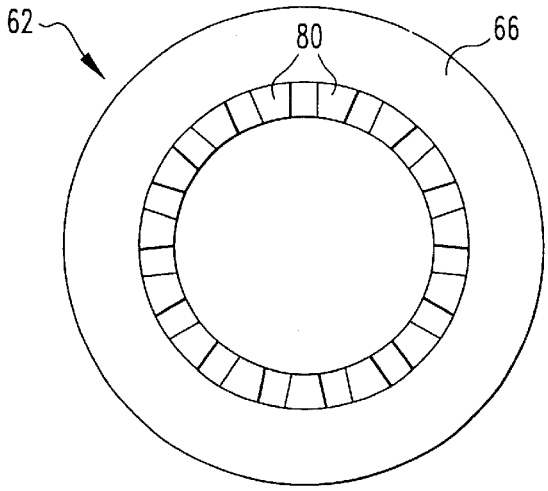
Figure 3F:
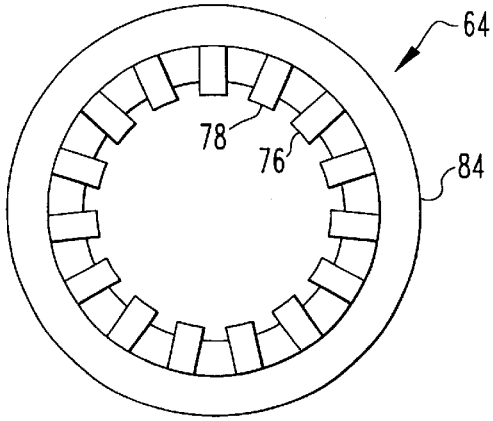
Figure 3G:
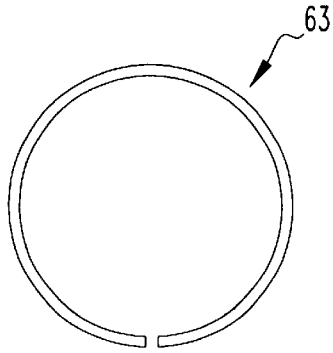
Figure 4:
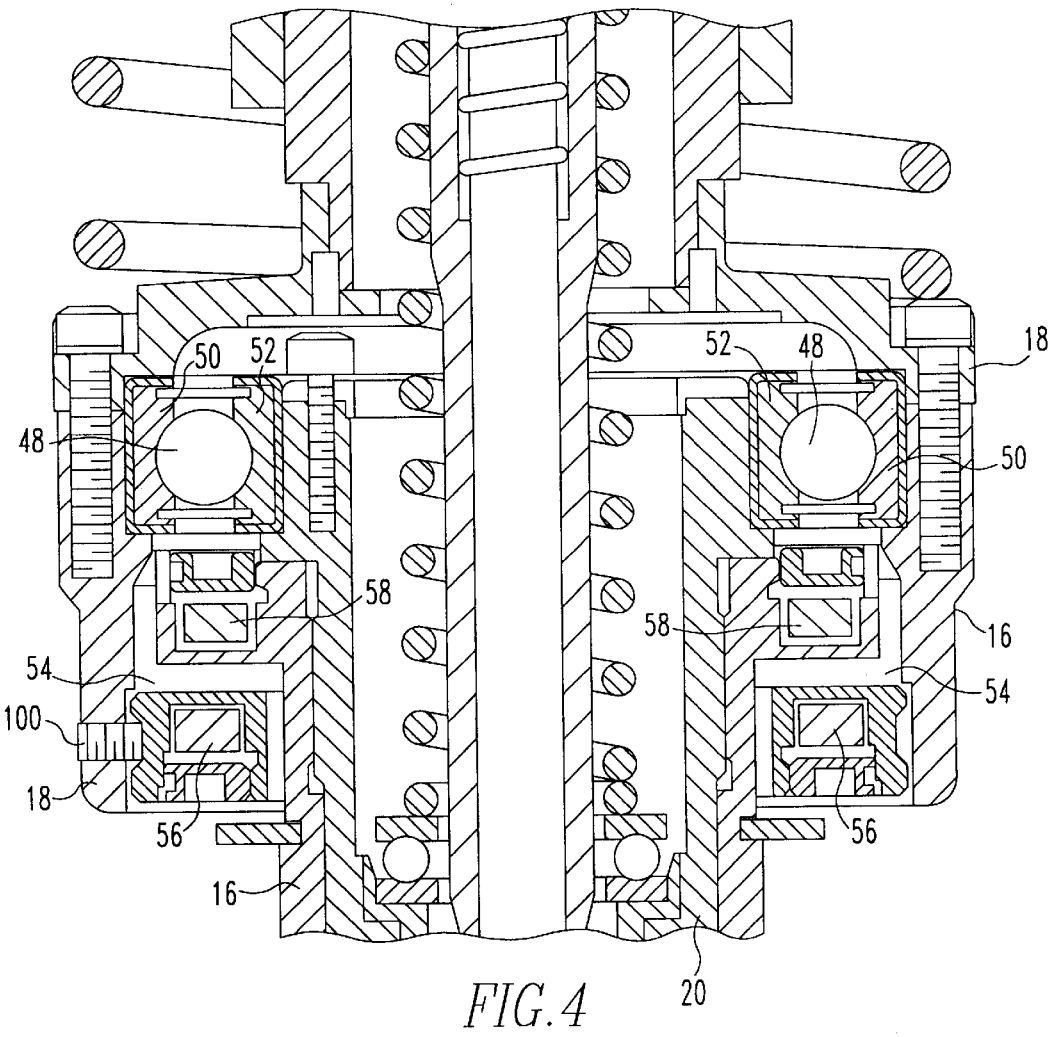
FIG. 4 is a detailed view of the clutch portion of the capping head assembly.

In FIGS. 1 and 2, there are shown alternative embodiments of the instant invention. The primary difference between these two embodiments is the location of the top load spring. As will be appreciated through the detailed description below, in FIG. 1, the top load spring is externally mounted relative to the spindle mounting collar and the upper portion of the clutch assembly housing. In FIG. 2, the top load spring is mounted internally relative to the spindle mounting collar and the upper portion of the clutch housing. In both drawings, like elements will be identified with like reference characters. Those specific elements whose structures are modified to accommodate the internal or external disposition of the top load spring will be identified with reference characters denoted as 'I' for internal and 'E' for external.

Referring now specifically to FIG. 1, a screw capping head assembly is generally indicated by the reference character 10. The assembly is designed to be attached by means of its spindle mounting collar 12 to a drive means that is not shown. It is common for a screw capping machine to be driven by a turret assembly having eight, ten, or more such screw capping heads as at described herein positioned in a circular fashion about a turret. Each capping head reciprocates up and down so as to move into alignment with a container that is to be sealed with a prethreaded closure. The screw capping head assembly 10 incorporates an upper housing 14 of which the spindle mounting collar 12 is one component, a clutch housing 16 comprising an upper portion 18 and a lower portion 20, and chuck assembly 22.

The upper housing 14 includes an adapter housing 24 with radially inwardly projecting splines 26. The spindle mounting collar 12 is mounted onto the adapter housing 24 by means of fastening screws 28. An axially disposed knockout rod 30 extends through an inner chamber 32 defined by the upper housing 14. The knockout rod 30 is spring biased by spring means 34 so as to be retained in a generally retracted position relative to the chuck 22. In operation, the knockout rod 30 is actuated by a cam system in the turret housing.

The clutch housing 16 has an upper portion 18 that includes radially outwardly extending splines 36 which cooperate with the splines 26 of the upper housing 14 to permit the axially displacement of the clutch housing 16 relative to the upper housing 14. The external top load spring 38E tends to bias the clutch housing 16 away from the upper housing 14. However, the clutch housing 16 is retained within the upper housing 14 by a radially extending shoulder portion 40 of the splined portion of the upper clutch housing that engages a corresponding should portion 42 in the spindle mounting collar. This configuration permits the clutch housing 16 to be compressed from a maximum extended position relative to the spindle mounting collar during the application of threaded closures to containers. As the assembly is rotated through the mounting of the spindle mounting collar onto a turret system, the rotation of the upper housing is transmitted to the clutch housing through the interconnected splines of the clutch housing and the upper housing.

As shown in FIG. 2, the internal top load spring is indicated by reference character 38I and is circumferentially disposed about the portion of the upper housing 14 defining the chamber 32. Internal spring 38I rests on an internal flange 44 of the spindle mounting collar 12.

Considering FIGS. 1 through 4, it can be seen that the clutch housing 16 includes an upper portion 18 and a lower portion 20. The lower portion 20 is supported by bearing means 48 so as to be freely rotatable relative to the upper portion 16 of the clutch housing 16. The external race 50 of the bearing means 48 is securely retained within the upper portion 18 of the clutch housing and the inner race 52 is retained by the lower portion 16 of the clutch housing. The rotational movement of the upper portion of the clutch housing is transmitted to the lower portion of the clutch housing by means of the magnetic clutch generally indicated by the reference character 54. The magnetic clutch 54 operates without contact, it is not affected by wear or by warming. Power transmission takes place via two magnet rings 56 and 58. The magnetic rings 56 and 58 are disposed one above the other in axial alignment. The bottom most magnetic ring or lower magnetic ring 56 is retained in a fixed position with respect to the upper portion 18 of the clutch housing. As will be described below, this magnetic ring includes an adjustment feature that allows the magnetic clutch 54 to be "zeroed" after final assembly of the capping head so as to permit the accurate adjustment of the magnetic clutch through a series of predetermined values.

Figure 5:
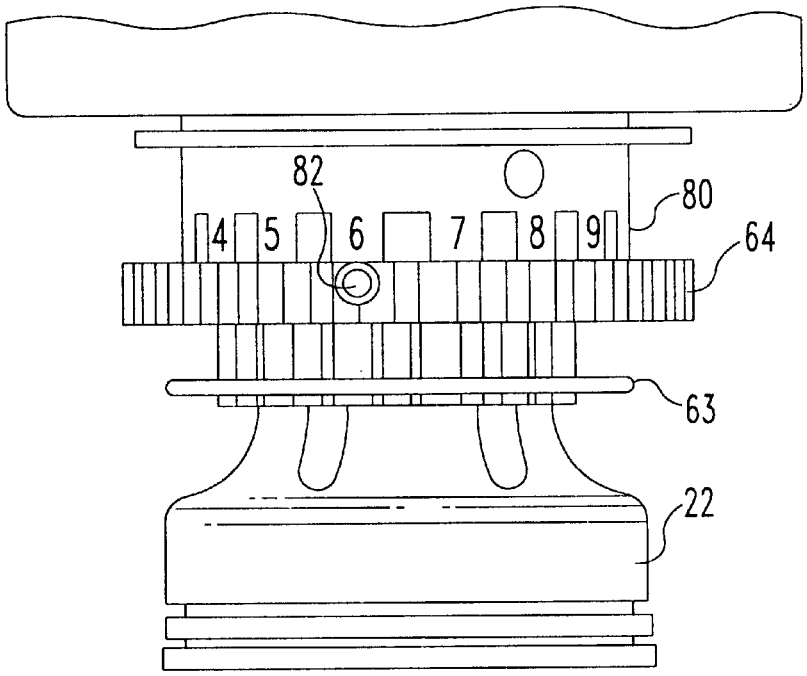
FIG. 5 is a detailed view of the torque adjustment controls in a locked position.
Figure 6:
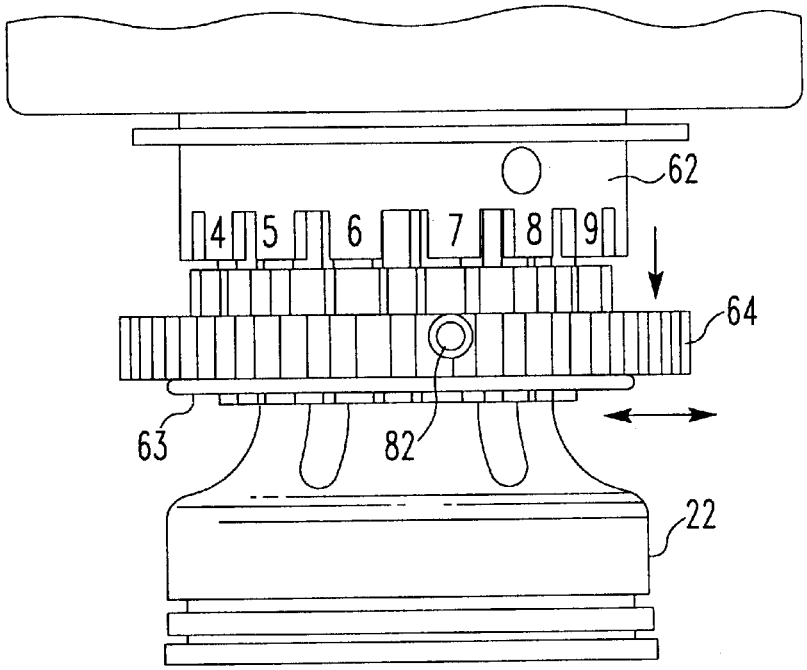
FIG. 6 is a detailed view of the torque adjustment controls in an open position.

The lower portion 20 of the clutch housing 16 is mounted by means of bearings 48 for free rotation relative to the clutch housing upper portion 16. As best viewed in FIG. 3, the clutch housing lower portion includes three primary elements: a first member 60 that is mounted for rotation in a fixed axial position relative to the clutch housing upper portion 18, a second member 62 axially displaceable relative to the first member 60 and locking means 64 for maintaining the second member 62 in a predetermined axially displaced position with respect to the first member 60. The upper magnetic ring 58 is mounted in a radially extending shoulder portion 66 of the second member 62. The first member 60 includes an upper threaded portion 68 and a lower splined portion 70. The second member 62 has internal threads 72 which engage the threaded portion 68 of the first member 60. As the second member 62 is rotated about its threaded portion, it travels axially with respect to the fixed location of the first member 60. The rotation of the second member 62 with respect to the first member 60 causes the upper magnetic ring 58 to approach or withdraw with respect to the lower magnetic ring 56. This travel toward and away from the lower fixed magnetic ring changes the air gap between the magnetic rings. The adjacent rings of magnets define the magnetic clutch and thus, as is well known by those skilled in the art, the transmittable torque between the clutch housing upper portion 18 and the clutch housing lower portion 20 is determined by the gap between the magnetic rings 56 and 58. Thus, when the magnets are closer together, there is a greater torque transmitted between the upper housing 14 with the upper portion of the clutch assembly 16 and the lower portion 20 of the clutch assembly. And, conversely, when the magnets of the rings 56 and 58 are spaced further apart, the torque is reduced. Generally speaking, the gap between the magnetic rings will vary between about 0.34 mm to 0.90 mm, which will provide a torque limit variation between 22.5 and 7.0 inch pounds respectively. The locking means 64 comprises a collar 74 that includes radially internally projecting splines 76 and axially upwardly extending teeth 78. The splines 76 of the collar 74 cooperate with the splined portion 70 of the first member 60. This cooperation facilitates the axial displacement of the collar 74 with respect to the second member 62. The second member 62 includes downwardly and axially projecting locking teeth 80 which cooperate with the upwardly extending teeth 78 of the locking means collar 74. When in its uppermost locked position, the locking means 76 prohibits the rotation of the second member 62 relative to the first member 60. When the collar 74 is axially distanced from the second member 62 so that the teeth 78 of the collar 74 and the locking teeth 80 of the second member 62 are not engaged, the second member 62 is rotatable relative to the first member 60 by means of the threaded portion 68. The locking means collar 74 may be retained in a locked position by means of a set screw 82 (see FIGS. 5 and 6) or by means of a magnetic ring 84 that biases the locking means in a closed, locking position relative to the second member 62. Preferably, the second member 62 may be rotated approximately 360° about the first member 60. This 360° rotation provides an optimum range of magnetic torque by moving the upper magnetic ring toward or away from the lower magnetic ring. The teeth 80 may be marked with indicia representing the several predetermined torque values. The adjustment ring 84 may be marked by an orientation point, such as the set screw 82 or some other indicia, to establish relative rotational displacement between the adjustment ring 84 and the second member 62. A snap ring 63 cooperates with snap ring groove 65 to limit the travel of locking means 64.

An additional feature of this capper assembly 10 is the plunger member 88 which is circumferentially disposed about the lockout rod 30. The plunger 88 is biased by spring means 90 which extend between the upper housing 14 along the upper housing member defining the chamber 32 and supported by thrust bearings 92 disposed between the spring and the upper portion 94 of the plunger 88. The plunger 88 is adapted to provide controlled downward pressure against the top of a bottle cap held in the chuck assembly 22. The bottom portion 96 of the plunger 88 contacts the face of the cap. However, the plunger 88 is retained so as to be freely rotatable within the lower portion 20 of the clutch housing 16. This permits the plunger to provide force to the cap while at the same time not scuffing the top of the cap as the chuck assembly tightens the cap onto the bottle.

The clutch assembly has a further adjustment feature that permits the zeroing of the magnetic clutch to a predetermined set value after the manufacture and assembly of the head set 10 is completed. This feature allows for the accurate calibration of each individually manufactured head set to a pre-established or desired value. The lower magnetic ring 56 which is mounted in the upper portion 18 of the clutch housing 16 permits this factory or calibrated adjustment of the magnetic clutch. The magnetic ring 56 is retained in the downwardly depending side walls of the upper housing portion 18 of the clutch housing 16 by means of mated threads provided on the magnetic ring 56 and the lower arms 98. With the adjustment ring 84 indicia 82 at a predetermined position, which indicates what will eventually be, after calibration the "zero" position, the threaded magnetic ring 56 is rotated to adjust the air gap with the magnetic ring 58. When the desired air gap is achieved, the magnetic ring 56 is locked in this position by a set screw 100. This final calibration permits the precise alignment of the pair of magnetic rings 56 and 58. Subsequent adjustment of the magnetic clutch is accomplished through the adjustment ring.

Thus it can be seen that the upper housing 14 when driven by the spindle mounting collar 12 causes the rotation of the upper portions 18 of the clutch housing 16. By means of the magnetic clutch 54 the lower portion 20 of the clutch housing 16 is driven. However, when the torque limit is reached, the lower portion 20 of the clutch housing will cease to rotate notwithstanding the continued rotation of the upper housing 14.

It is intended to cover by the appended claims all modification which come within the true spirit and scope of the invention.

Having described the invention, what is claimed is:

1. A capping head assembly comprising a first housing having a spindle mounting collar means and means for supporting a clutch housing, said clutch housing having an upper portion with a first magnetic ring means and a lower portion with a second magnetic ring means, wherein said first housing means includes spline means and said clutch housing upper portion includes spline means adapted to cooperate with said first housing spline means for the axial displacement of said clutch housing relative to said first housing, and wherein said lower portion is freely rotatable relative to said upper portion, said lower portion including means for establishing an adjustable air gap between said first and second magnetic ring means, and locking means for maintaining said means for adjusting an air gap at a selected value.

2. The capping head assembly according to claim 1 wherein the first housing and the clutch housing are biased with respect to each other so as to be maintained in a spaced relationship.

3. The capping head assembly according to claim 2 including spring means disposed between the first housing and the clutch housing to effect the maintenance thereof in the spaced relationship.

4. The capping head assembly according to claim 1 wherein the clutch housing upper portion and clutch housing lower portion are rotatable relative to each other by means of a bearing means having an outer race in mechanical communication with said upper portion and an inner race in mechanical communication with said lower portion.

5. The capping head assembly according to claim 1 wherein the clutch lower portion means for establishing an adjustable air gap between the first and second magnetic ring means, comprises a first member mounted for rotation in a fixed axial position relative to the clutch housing upper portion; a second member axially displaceable relative to said first member, and locking means for maintaining said second member in a predetermined position relative to said first member.

6. The capping head assembly according to claim 5 wherein the clutch housing lower portion second member is axially displaceable relative to said clutch housing lower portion first member by thread means which permit the rotation of said second member about said first member.

7. The capping head assembly according to claim 5 wherein the clutch housing lower portion first member includes an upper threaded portion and a lower spined portion and wherein the clutch housing lower portion second member is threadedly engaged with said first member and the locking means has splines which engage said second member splined portion to permit said locking means to move from a first locked position in which said locking means engages said second member and a second unlocked position in which said locking means is disengaged from said second member so that said second member is rotatable about said first member.

8. The capping head assembly according to claim 7 wherein the clutch housing lower portion second member includes means for supporting the second magnetic ring means, and the clutch housing upper portion includes means for supporting the first magnetic ring means so that rotatable movement of the second member about the first member adjusts the air gap between said first and second magnetic ring means.

9. The capping head assembly according to claim 7 wherein the locking means is maintained in a locked position by means of a set screw.

10. The capping head assembly according to claim 7 wherein the locking means includes magnetic means for retaining the locking means in a first locked position relative to said second member by means of magnetic attraction between said locking means and said second member.

11. The capping head assembly according to claim 1 wherein the clutch housing upper portion includes means for axially displacing the first magnetic ring relative thereto in order to calibrate the adjustable air gap between the first and second magnetic ring means after the assembly of the capping head assembly.

12. The capping head assembly according to claim 1 wherein the locking means includes indicia means to facilitate the identification of value of the adjustable air gap established between the first and second magnetic ring means.

13. The capping head assembly according to claim 7 wherein the clutch housing lower portion second member includes at one end thereof teeth means and the locking means includes teeth means which interlock with the teeth means of said second member to prohibit rotational movement of said second member relative to said locking means.

14. The capping head assembly according to claim 13 wherein the locking means splines prohibit rotation of said locking means relative to said clutch housing lower portion first member and said locking means teeth means prohibit rotation of said second member relative to said first member whereby the adjustable air gap between the first and second magnetic ring means are maintained at a selected value.

15. A capping head assembly comprising a first housing having a spindle mounting collar means and means for supporting a clutch housing, said clutch housing having an upper portion with a first magnetic ring means and a lower portion with a second magnetic ring means, wherein said lower portion has a first member mounted for rotation in a fixed axial position relative to the clutch housing upper portion; a second member axially displaceable relative to said first member, said second magnetic ring means being mounted in said second member, whereby the axial displacement of said second member establishes an adjustable air gap between said first and second magnetic ring means, and locking means for maintaining said second member in a predetermined position relative to said first member.

16. The capping head assembly according to claim 15 wherein the clutch housing lower portion second member is axially displaceable relative to said clutch housing lower portion first member by thread means which permit the rotation of said second member about said first member.

17. The capping head assembly according to claim 15 wherein the clutch housing lower portion first member includes an upper threaded portion and a lower spined portion and wherein the clutch housing lower portion second member is threadedly engaged with said first member and the locking means has splines which engage said second member splined portion to permit said locking means to move from a first locked position in which said locking means engages said second member and a second unlocked position in which said locking means is disengaged from said second member so that said second member is rotatable about said first member.

18. An capping head assembly with an adjustable magnetic clutch comprising a clutch housing upper portion with a first magnetic ring means and a lower portion with a second magnetic ring means, wherein said lower portion is freely rotatable relative to said upper portion, said lower portion including means for establishing an adjustable air gap between said first and second magnetic ring means comprising a first member mounted for rotation in a fixed axial position relative to the clutch housing upper portion; a second member axially displaceable relative to said first member, said second member including means for supporting said second magnetic ring means so that rotatable movement of the second member about the first member adjusts the air gap between said first and second magnetic ring means and wherein one of said upper portion and lower portions includes means for axially displacing said first or second respective magnetic ring means relative to its respective upper or lower portion in order to calibrate the adjustable air gap between said first and second magnetic ring means independent of the rotatable movement of the second member about the first member.

19. The capping head assembly according to claim 18 wherein the first housing means includes spline means and the clutch housing upper portion includes spline means adapted to cooperate with said first housing spline means for the axial displacement of said clutch housing relative to said first housing.

20. The capping head assembly according to claim 19 wherein the first housing and the clutch housing are biased with respect to each other so as to be maintained in a spaced relationship.

21. The capping head assembly according to claim 20 including spring means disposed between the first housing and the clutch housing to effect the maintenance thereof in the spaced relationship.

22. The capping head assembly according to claim 18 wherein the clutch housing upper portion and clutch housing lower portion are rotatable relative to each other by means of a bearing means having an outer race in mechanical communication with said upper portion and an inner race in mechanical communication with said lower portion.

23. The capping head assembly according to claim 18 wherein the clutch housing lower portion means for establishing an adjustable air gap between the first and second magnetic ring means, comprises a first member mounted for rotation in a fixed axial position relative to the clutch housing upper portion; a second member axially displaceable relative to said first member, and locking means for maintaining said second member in a predetermined position relative to said first member.

24. The capping head assembly according to claim 23 wherein the clutch housing lower portion second member is axially displaceable relative to said clutch housing lower portion first member by thread means which permit the rotation of said second member about said first member.

25. The capping head assembly according to claim 23 wherein the clutch housing lower portion first member includes an upper threaded portion and a lower splined portion and wherein the clutch housing lower portion second member is threadedly engaged with said first member and the locking means has splines which engage said second member splined portion to permit said locking means to move from a first locked position in which said locking means engages said second member and a second unlocked position in which said locking means is disengaged from said second member so that said second member is rotatable about said first member.

26. The capping head assembly according to claim 25 wherein the clutch housing lower portion second member includes means for supporting the second magnetic ring means, and the clutch housing upper portion includes means for supporting the first magnetic ring means so that rotatable movement of the second member about the first member adjusts the air gap between said first and second magnetic ring means.

27. The capping head assembly according to claim 25 wherein the locking means is maintained in a locked position by means of a set screw.

28. The capping head assembly according to claim 25 wherein the locking means includes magnetic means for retaining the locking means in a first locked position relative to said second member by means of magnetic attraction between said locking means and said second member.

29. The capping head assembly according to claim 18 wherein the locking means includes indicia means to facilitate the identification of value of the adjustable air gap established between the first and second magnetic ring means.

30. The capping head assembly according to claim 25 wherein the clutch housing lower portion second member includes at one end thereof teeth means and the locking means includes teeth means which interlock with the teeth means of said second member to prohibit rotational movement of said second member relative to said locking means.

31. The capping head assembly according to claim 21 wherein the locking means splines prohibit rotation of said locking means relative to said clutch housing lower portion first member and said locking means teeth means prohibit rotation of said second member relative to said first member whereby the adjustable air gap between the first and second magnetic ring means are maintained at a selected value.

* * * * *